US006179562B1

(12) United States Patent
Fujinaka

(10) Patent No.: US 6,179,562 B1
(45) Date of Patent: Jan. 30, 2001

(54) BLOWER

(75) Inventor: Hiroyasu Fujinaka, Kadoma (JP)

(73) Assignee: Matsushita Electric Industrial Co., Ltd. (JP)

( * ) Notice: Under 35 U.S.C. 154(b), the term of this patent shall be extended for 0 days.

(21) Appl. No.: 09/355,765

(22) PCT Filed: Dec. 24, 1998

(86) PCT No.: PCT/JP98/05933

§ 371 Date: Aug. 4, 1999

§ 102(e) Date: Aug. 4, 1999

(87) PCT Pub. No.: WO99/34118

PCT Pub. Date: Aug. 7, 1999

(51) Int. Cl.[7] ..... F04D 29/66

(52) U.S. Cl. ..... 415/208.5; 415/119; 415/211.1; 415/914; 416/247 R

(58) Field of Search ..... 415/119, 186, 415/187, 208.3, 208.5, 209.1, 211.1, 220, 223, 914, 214.1; 416/247 R

(56) References Cited

U.S. PATENT DOCUMENTS 2,628,018 * 2/1953 Koch ..... 415/211.1
5,292,088 * 3/1994 Lemont ..... 416/247 R
5,393,197 * 2/1995 Lemont et al. ..... 415/211.1
5,407,324 * 4/1995 Starnes, Jr. et al. ..... 415/208.2
5,707,205 * 1/1998 Otsuka ..... 415/119

FOREIGN PATENT DOCUMENTS 57-95500 6/1982 (JP) .
3-38694 4/1991 (JP) .
3-41995 4/1991 (JP) .
4-183998 6/1992 (JP) .

* cited by examiner

*Primary Examiner*—Christopher Verdier
(74) *Attorney, Agent, or Firm*—Parkhurst & Wendel, L.L.P.

(57) ABSTRACT

A blower comprising an annular wall (2) formed to be spaced from blade tips of a fan (1), the annular wall having slits (6) formed at a portion opposed to the blade tips to establish communication between inner and outer peripheral portions of the annular wall, so that air is sucked into the inner peripheral portion of the annular wall through the slits as the fan rotates, characterized in that the width w of a gap of the slit is changed in radial and circumferential directions thereof, whereby the quantity of air flowing into the inner peripheral portion of the annular wall through the slits is made substantially equal over the entire circumference. By this configuration, leakage vortexes flowing from the pressure side to the suction side at the blade tips are restrained, and the P–Q characteristics are improved. At the same time, noise produced in the annular wall having slits can be restrained, so that a low-noise blower can be realized.

4 Claims, 15 Drawing Sheets

FIG. 1(a)
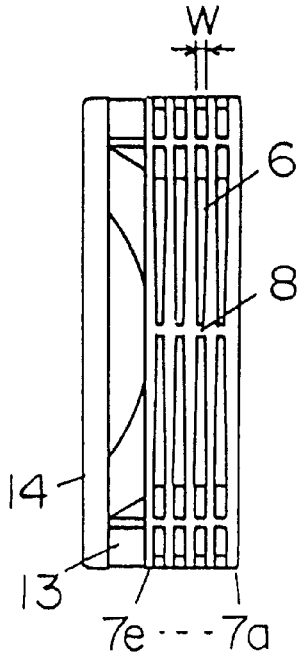
FIG. 1(b)
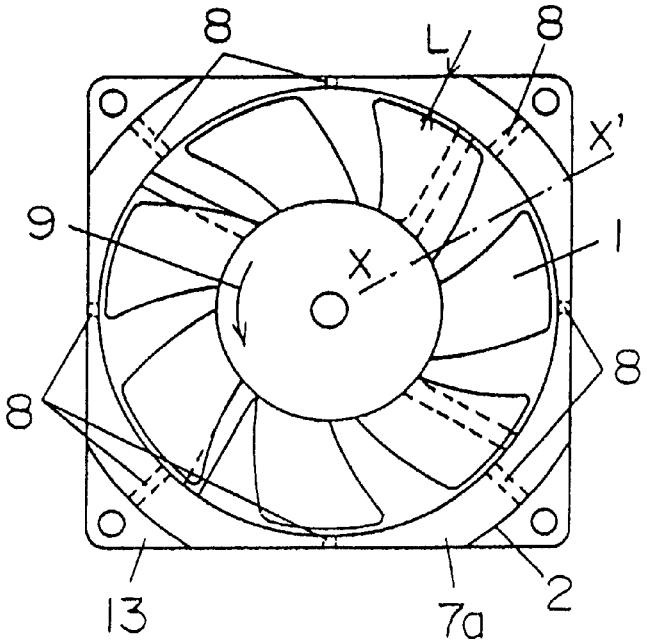
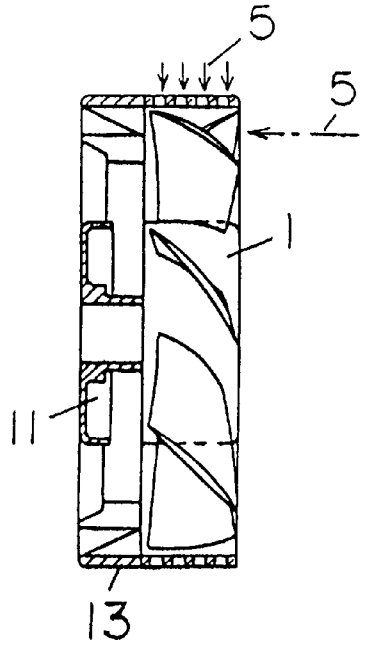
FIG. 1(c)
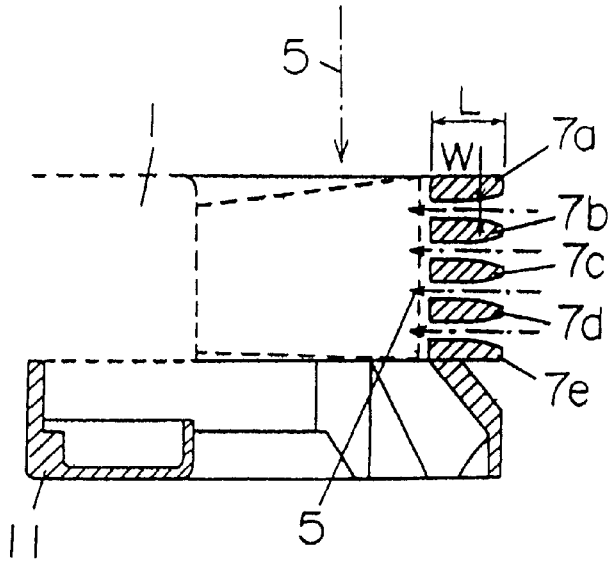
FIG. 1(d)

FIG. 2(a)
PRIOR ART
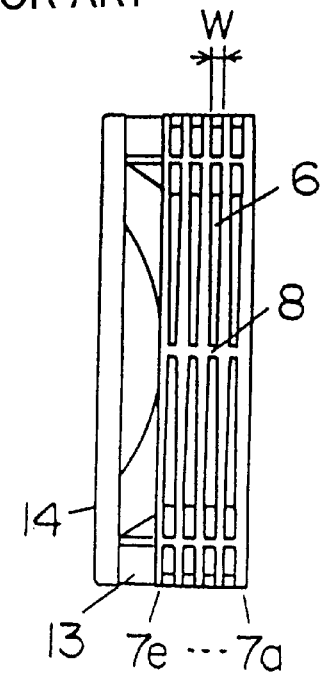
FIG. 2(b)
PRIOR ART
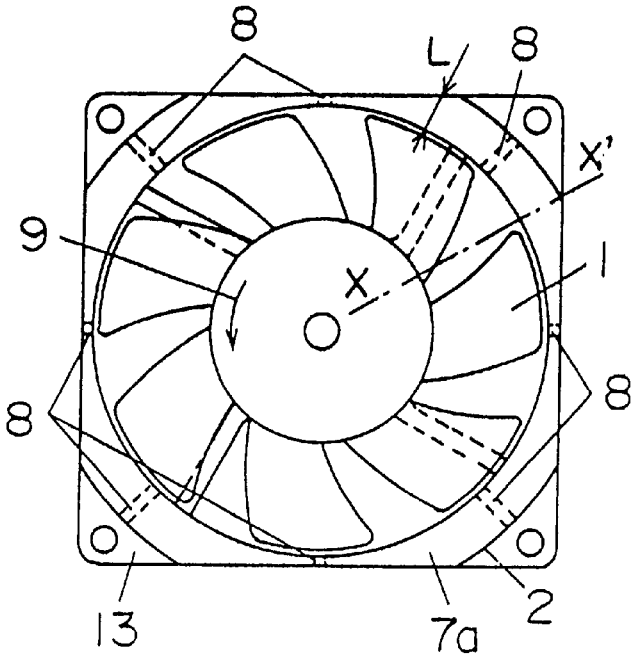
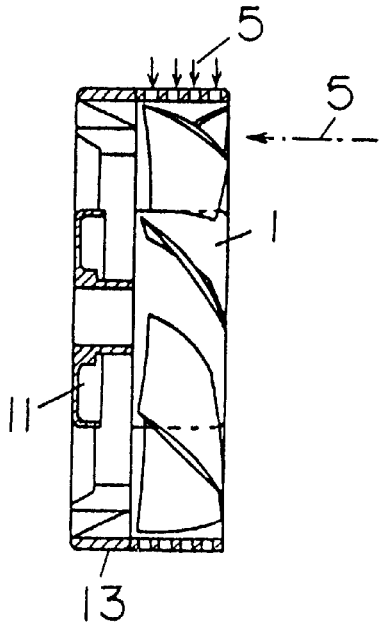
FIG. 2(c)
PRIOR ART
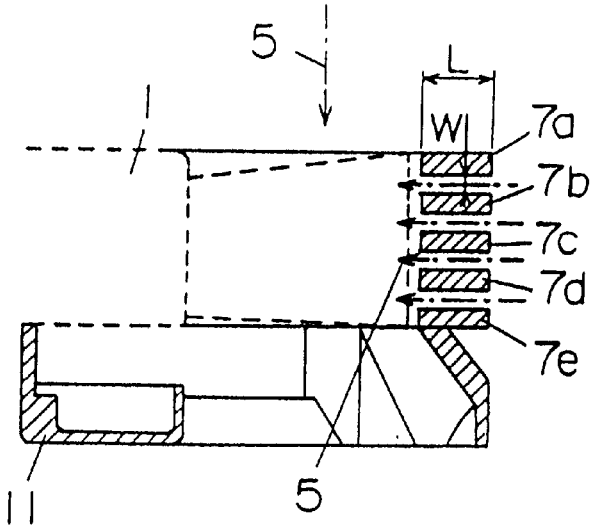
FIG. 2(d)
PRIOR ART FIG. 10(a)
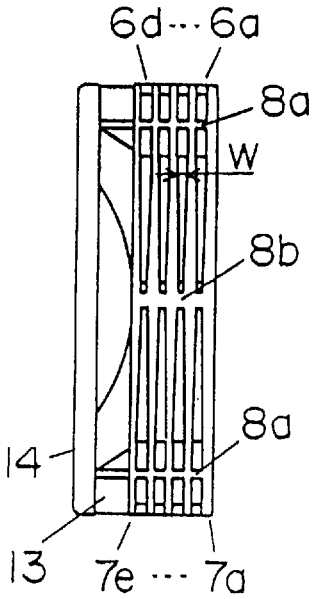
FIG. 10(b)
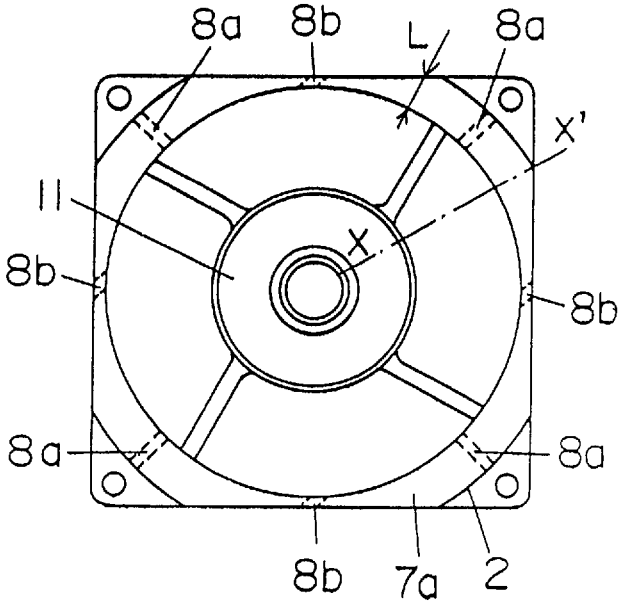
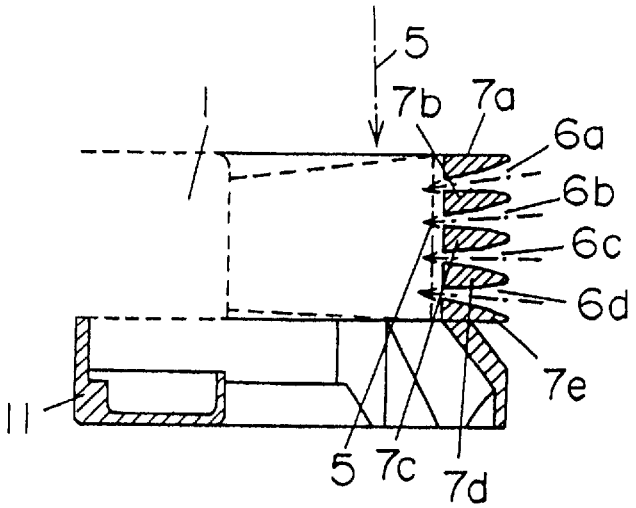
FIG. 10(c)

NORMAL STATE

UNDER HIGH STATIC PRESSURE

FIG. 14(a)
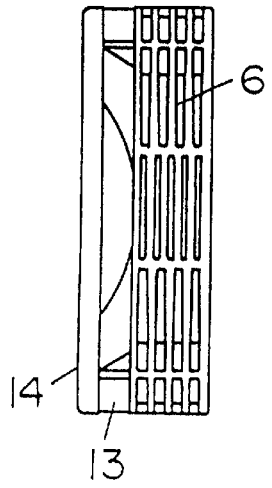
FIG. 14(b)
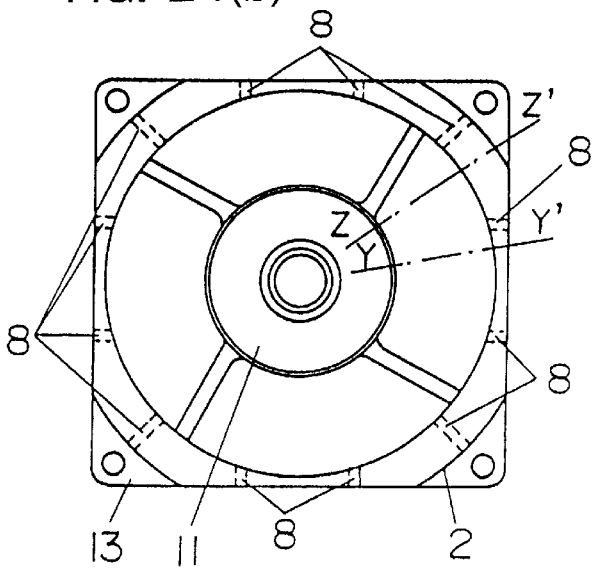
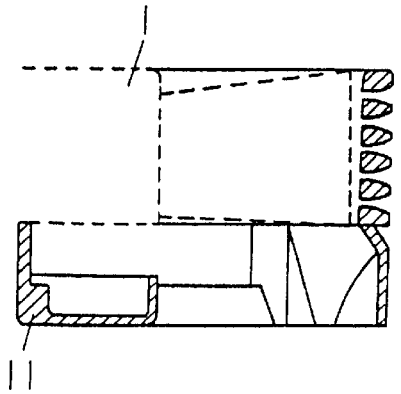
FIG. 14(c)
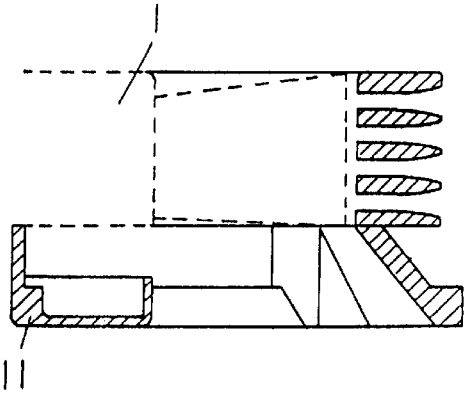
FIG. 14(d)

FIG. 16(a)
PRIOR ART
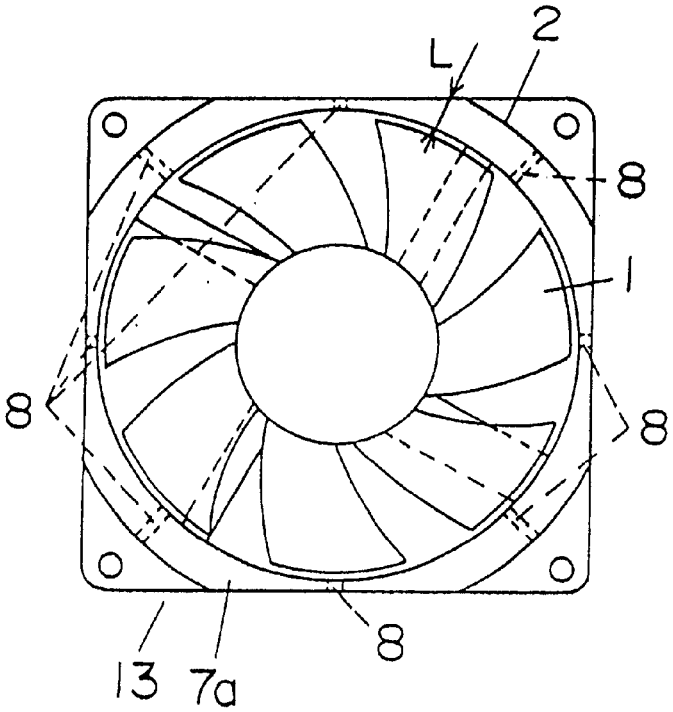
FIG. 16(b)
PRIOR ART
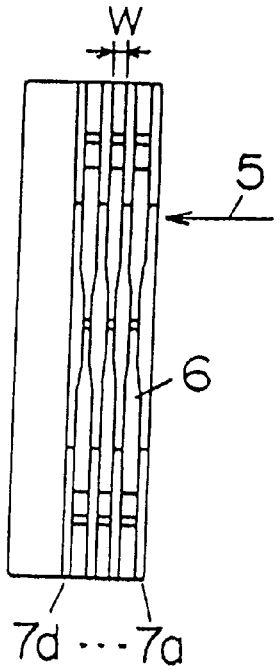
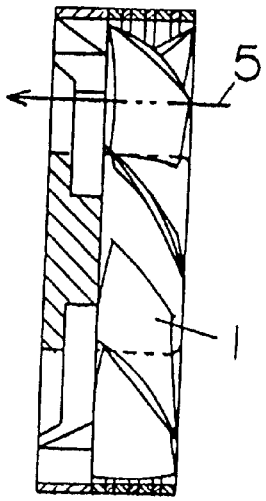
FIG. 16(c)
PRIOR ART

BLOWER

TECHNICAL FIELD

The present invention relates to a blower.

BACKGROUND ART

In recent years, high-density mounting of electrical circuits has been used widely as equipment is miniaturized and goes electronic. Accordingly, because of the increase in heat density of electronic equipment, a blower has been used for cooling the equipment. For a conventional blower, as shown in FIG. 15, an annular wall 2 is formed to be spaced from blade tips of an axial-flow fan 1, and the axial-flow fan 1 rotates around a shaft 4 in a blowing state in which a motor 3 is energized, by which an air flow 5 directed from the suction side to the discharge side is generated.

However, in the aforementioned blowing state, the velocity of the air flow increases on the suction side of the blade tips, and a low-energy zone due to the effect of an inter-blade secondary flow is produced on the blade trailing edge side where the air flow is converted into pressure energy. In this zone, a loss is great, and the flow is liable to be separated. The air flow is separated from the blade surface, so that vortexes are produced in the separation region, by which turbulence noise is increased, and the noise level and the static pressure vs. air quantity characteristics (hereinafter referred to as P–Q characteristics) are deteriorated. This phenomenon is frequently found especially when a flow resistance (system impedance) is applied to the discharge flow side and when the occurrence of leakage vortexes at the blade tips increases, by which the fan gets into a stalling state. As a blower in which the shape of the annular wall provided at the outer periphery of the fan is devised to improve such fan characteristics, blowers described in Japanese Patent Application No. 8-174042, Japanese Patent Application No. 9-151450 and Japanese Patent Application No. 9-260738 have been proposed by the same applicant as the one of the present invention. Also, National Publication of International Patent Application No. 6-508319 and U.S. Pat. No. 5,292,088 have disclosed blowers in which a plurality of ring bodies are arranged at intervals at the outer periphery of an axial-flow fan, so that vortexes of air flowing in through gaps between the ring bodies increase the flow rate of fluid. Further, U.S. Pat. No. 5,407,324 has disclosed a blower in which a plurality of annular plates surrounding the outer periphery of an axial-flow fan are stacked and the inner peripheral portion of said annular plates being inclined along the direction of air, whereby the flow of air between the inner periphery and the outer periphery of the annular wall is enabled. In all of these blowers, the fan characteristics are improved by the suction of air from the outer periphery of the fan.

However, for a rectangular blower having an external shape ranging from about 60 mm×60 mm to about 92 mm×92 mm, which is used for personal computers, workstations and the like, the shape, dimensions, etc. are made common to reduce the cost, so that a large change so as to make the external shape circular is undesirable. To improve the characteristics of a blower having an outer peripheral shape other than circular one, Japanese Patent Application No. 9-151450 and Japanese Patent Application No. 9-260738 filed by the same applicant as the one of the present invention have disclosed a method for improving the characteristics by providing slits in the annular wall and changing the width of a slit gap. FIGS. 16 to 18 show a blower disclosed in Japanese Patent Application No. 9-151450. As shown in FIG. 16(*b*), the total width of stacked annular plates 7*a* to 7*d* is set so as to be the same or almost the same as the width in the axial direction of an axial-flow fan 1. Also, the width w of a gap of each slit 6 is changed continuously so that the inflow resistance at each portion is equal. FIG. 18 schematically shows a case where the width w of the gap of the slit 6 is constant over the entire circumference. When the axial-flow fan 1 is rotated in the direction of an arrow 9, a negative pressure is produced on the suction side at the blade tips, so that an air flow 5 toward the inside through the slits 6 is generated by a difference in pressure between the inside and the outside. By setting the width w of the gap of the slit 6 at an appropriate value, the air flow 5 flowing in through the slits 6 is made a laminar flow, so that leakage vortexes 10 flowing from the pressure side to the suction side at the blade tips are restrained, by which the separation of the air flow on the suction side surface is eliminated. In this case, however, the slits at four-side portions 7*s* have a lower air inflow resistance than the slits at other portions 7*r*, so that the air inflow quantity at the four-side portions 7*s* becomes larger than that at the other portions 7*r*. Therefore, the air flow at this portion is prone to become a turbulent flow, and at the same time, a portion having a high flow rate and a portion having a low flow rate are produced on the fan, causing the blade to vibrate, or a disk circulation 12 is easily generated such that the air flows backward from the downstream-side slit and is sucked again into the upstream-side slit, which deteriorates the P–Q characteristics and causes noise to increase. By contrast, FIG. 17 shows a case where the width w of the gap of the slit 6 is changed continuously so that the inflow resistance at each portion is equal. In this case, both of the slits at four-side portions 7*s* and the slits at other portions 7*r* have an equal air inflow resistance, so that the air inflow quantity is equal over the entire circumference, which restrains blade vibrations, disk circulation, etc., and eliminates the deterioration of the P–Q characteristics and the increase of noise.

However, in the aforementioned technology, the width w of the gap of the slit 6 is assumed to be constant in the radial direction, so that the radial cross section of the annular plate 7*a* to 7*d* is inevitably rectangular. By this configuration, although the P–Q characteristics are greatly improved by the above-described effect, regarding the noise, the annular wall itself, which is provided with slits, becomes a new noise source. Under such a service condition that a great stall does not occur even in a conventional blower, particularly at a low pressure, the noise sometimes increases on the contrary.

An object of the present invention is to further improve the shape of a slit portion and especially to reduce the noise in a blower in which an annular wall as described above is formed with slits which provide communication between the inner peripheral portion and the outer peripheral portion, and air is sucked into the inner peripheral portion of the annular wall through the slits as a fan rotates.

DISCLOSURE OF THE INVENTION

The present invention provides a blower having slits in an annular wall as described above. In a blower in which an annular wall is formed to be spaced from blade tips of a fan, the annular wall having slits formed at a portion opposed to the blade tips to provide communication between the inner and outer peripheral portions of the annular wall, so that air is sucked into the inner peripheral portion of the annular wall through the slits as the fan rotates, wherein the width w(l) of a gap of the slit is changed in the radial and circumferential directions, whereby the quantity of air flowing into the inner peripheral portion of the annular wall through the slits is made substantially equal over the entire circumferences. By this configuration, leakage vortexes flowing from the pressure side to the suction side at the blade tips are restrained, and P–Q characteristics are improved. At the same time, noise produced in the annular wall having slits can be restrained, so that a low-noise blower can be realized.

The invention defined in the claims of the present invention provides a blower comprising an annular wall formed to be spaced from blade tips of a fan, the annular wall having slits formed at a portion opposed to the blade tips to establish communication between the inner and outer peripheral portions of the annular wall, so that air is sucked into the inner peripheral portion of the annular wall through the slits as the fan rotates, characterized in that where the length of an air flow from the inner periphery to the outer periphery of the annular wall is taken as L, and the width of a gap of the slit at a distance l from the inner periphery of the slit is taken as w(l), in order to satisfy the condition expressed as $$\int_0^L \frac{1}{w(l)^3} dl = \text{constant}$$

or its approximate condition, the width w(l) of the gap of the slit is changed in radial and circumferential directions, whereby the quantity of air flowing into the inner peripheral portion of the annular wall through the slits is made substantially equal over the entire circumference. Therefore, the P–Q characteristics of the blower can be improved, and low noise can be achieved.

The invention defined in the claims of the present invention provides a blower comprising an annular wall formed to be spaced from blade tips of a fan, the annular wall having slits formed at a portion opposed to the blade tips to establish communication between the inner peripheral portion and the outer peripheral portion of the annular wall, so that air is sucked into the inner peripheral portion of the annular wall through the slits as the fan rotates, characterized in that where the length of an air flow from the inner periphery of the annular wall to the outer periphery thereof is taken as L, the width of a gap of the slit at a distance l from the inner periphery of the slit is taken as w(l), and the number of slits in the direction of a rotating shaft is taken as n, in order to satisfy the condition expressed as $$\frac{1}{n} \cdot \int_0^L \frac{1}{w(l)^3} dl = \text{constant}$$

or its approximate condition, the number of the slits is changed, and at the same time, the width w(l) of the gap is changed in radial and circumferential directions, whereby the quantity of air flowing into the inner peripheral portion of the annular wall through the slits is made substantially equal over the entire circumference. Therefore, the P–Q characteristics of the blower can be improved, and low noise can be achieved.

In the invention defined in the claims of the present invention, the angle of the direction of an air inflow through the slit is formed to be inclined with respect to a plane perpendicular to the fan rotating shaft. Therefore, the efficiency of the blower can be enhanced.

In the invention defined in the claims of the present invention, the width of the gap of the slit increases from the inner periphery toward the outer periphery in the same circumferential direction of the annular wall. Therefore, the flow of air through the slit is made smooth, and the noise level can be reduced.

BRIEF DESCRIPTION OF THE DRAWINGS

FIG. 1(*a*) is a side view of a blower in accordance with Embodiment 1 of the present invention, FIG. 1(*b*) is a front view thereof, FIG. 1(*c*) is a sectional view thereof, and FIG. 1(*d*) is a detailed sectional view taken along the line X—X' of FIG. 1(*b*);

FIG. 2(*a*) is a side view of a blower of a prior art (Japanese Patent Application Laid-Open No. 9-151450), FIG. 2(*b*) is a front view thereof, FIG. 2(*c*) is a sectional view thereof, and FIG. 2(*d*) is a detailed sectional view taken along the line X—X' of FIG. 2(*b*);

FIG. 10(*a*) is a side view of a housing for a blower in accordance with Embodiment 2 of the present invention, FIG. 10(*b*) is a front view thereof, and FIG. 10(*c*) is a detailed sectional view taken along the line X—X' of FIG. 10(*b*);

FIG. 14(*a*) is a side view of a housing for a blower in accordance with Embodiment 3 of the present invention, FIG. 14(*b*) is a front view thereof, FIG. 14(*c*) is a detailed sectional view taken along the line X—X' of FIG. 14(*b*), and FIG. 14(*d*) is a detailed sectional view taken along the line Z—Z' of FIG. 14(*b*);

FIG. 16(*a*) is a front view of the blower of the prior art (Japanese Patent Application Laid-Open No. 9-151450), FIG. 16(*b*) is a side view thereof, and FIG. 16(*c*) is a sectional view thereof;

Figure 3:
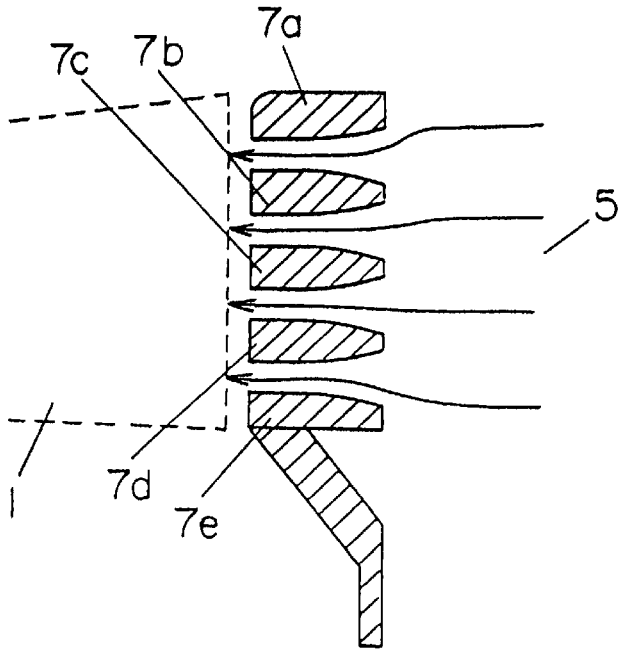
FIG. 3 is a view showing the flow of air at a slit portion of the blower in accordance with Embodiment 1 of the present invention.

BEST MODE FOR CARRYING OUT THE INVENTION (Embodiment 1)

FIGS. 1(*a*) to 1(*d*) show a blower in accordance with Embodiment 1. As shown in FIGS. 1(*a*) to 1(*d*), a housing 13 has a boss portion 11 serving as a bearing support portion to which a motor portion is fixed and a base portion 14 which is the installation reference of the blower, and includes annular plates 7*a* to 7*e* connected longitudinally via spacers 8 on the base portion 14. These annular plates 7*a* to 7*e* have such a shape that is obtained by cutting a thin ring body to be linear on four sides thereof. Thus laminated annular plates 7*a* to 7*e* are installed in the direction of the rotating shaft of an axial-flow fan 1, and all of these elements are integrally formed with a resin. Also, a gap of each slit 6 is formed so that the outer peripheral side of an annular wall is wider than the inner peripheral side thereof by forming the cross section of the annular plate into a spindle shape. Further, the width of the gap of each slit 6 is changed in the circumferential direction, by which the inflow resistance of each portion is made equal over the entire circumference.

Figure 4:
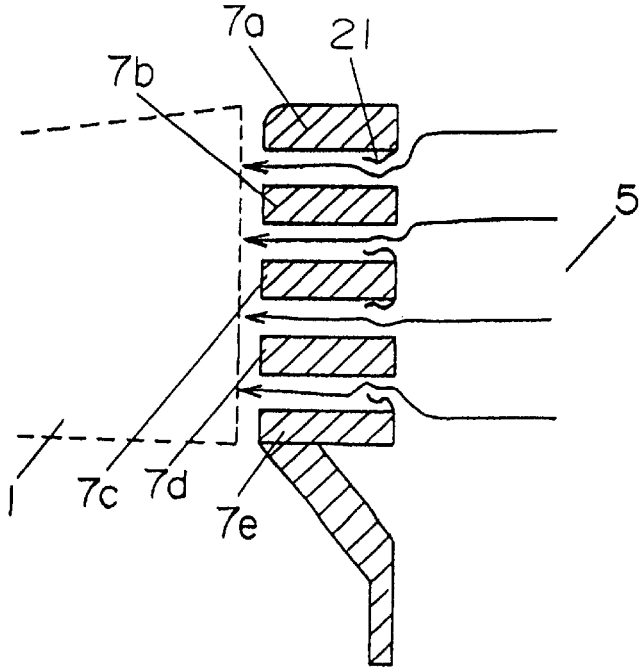
FIG.4 PRIOR ART
FIG. 4 is a view showing the flow of air at a slit portion of the blower of the prior art (Japanese Patent Application Laid-Open No. 9-151450)

To clarify the features of the blower in accordance with the present invention, the blower of this embodiment is explained by comparing with a blower of the prior art. FIGS. 2(*a*) to 2(*d*) show a case where the width of a gap of a slit is not changed in the radial direction as described in the prior art (Japanese Patent Application No. 9-151450). The blower shown in FIG. 2 is exactly the same as the blower of this embodiment shown in FIG. 1 except that the width w of the gap of the slit 6 is constant in the radial direction. FIG. 4 is a view showing the flow of air in a cross section of X—X' of FIG. 2(*b*) showing the prior art blower. As shown in FIG. 4, air flow 5 flowing from the outer periphery of the annular wall into the inner periphery thereof flows into the slit 6 in such a manner as to once collide with the outer peripheral portion of the annular wall. By setting the width w of gap of the slit 6 appropriately, the air flow 5 flowing in through the slit 6 flows into the inner periphery of the annular wall in a laminar state by the straightening effect of the slit 6. Therefore, although a satisfactory effect can be obtained in terms of the effect of improving P–Q characteristics, a turbulence 21 of air flow is produced when the air flow 5 collides with the outer peripheral portion of the annular wall, by which noise is generated from this portion. FIG. 3 shows the flow of air in a cross section of X—X' of FIG. 1(*b*) showing this embodiment. As shown in FIG. 3, the air flow 5 flowing in from the outer periphery of the annular wall is introduced into the inner periphery of the annular wall along the spindle-shaped annular plates 7*a* to 7*e*, so that the turbulence of air flow generated when the air flow 5 flows into the slit 6 is kept to a minimum. By this configuration, the P–Q characteristics are improved, and at the same time, the noise generated at the slits 6 is kept to a minimum, so that lowering of the blower noise can be achieved. Here, a condition for equalizing the inflow resistance at the slits 6 is described by taking an example.

Figure 5:
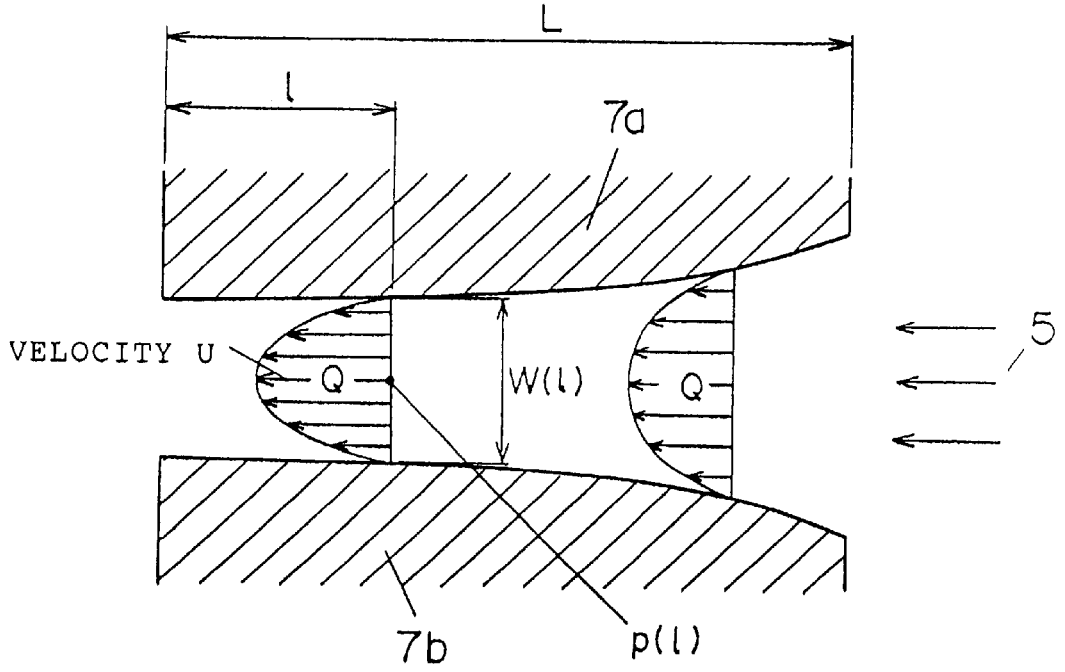
FIG. 5 is a view showing the flow of air inside a slit of the blower in accordance with Embodiment 1 of the present invention.

FIG. 5 is a schematic view showing a velocity distribution of air in the slit 6. The flow of air in the slit 6 is assumed to be a laminar flow, and the inertia force of air, the compression of air, etc. are neglected. In FIG. 5, L denotes the length in the direction of an air flow from the inner periphery to the outer periphery of the annular wall, w(l) denotes the width of the gap of the slit at a position at a distance l from the inner periphery of the slit, p(l) denotes a pressure at this position, u denotes the velocity of the air flow, and Q denotes the quantity of air flowing in through a unit slit per unit time.

The distribution of the velocity u in the slit 6 is parabolic as shown in FIG. 5, and the quantity Q of air flowing in through a unit slit per unit time is expressed as $$Q = \frac{w(l)^3}{12\eta}\frac{dp(l)}{dx} \tag{1}$$

where, η is viscosity of air. Here, taking the length in the flow direction of the slit 6 as L, and the difference in atmospheric pressure between the inside and the outside of the slit as ΔP, Equation 1 is rewritten as $$Q = \frac{\Delta P}{12\eta\int_0^L \frac{1}{w(l)^3}dl} \tag{2}$$

Since ΔP is caused by the rotation of a fan, and the viscosity η of air is constant at each portion, the condition for making Q constant is expressed as $$\int_0^L \frac{1}{w(l)^3}dl = \text{constant} \tag{3}$$

Therefore, it is found that by optimizing the width of the gap of the slit 6 in accordance with this equation, the inflow quantity of air is made equal over the entire circumference, which restrains blade vibrations and the like, so that deterioration in the P–Q characteristics and increase in noise can be prevented.

The above-described optimizing condition is a condition in the state in which the inertia force of air, the compression of air and the like are neglected, so that the actual optimizing condition is slightly deviates from this condition. However, this deviattion is very small because a state in which the flow in the slit portion is laminar, that is to say, a state in which the inertia force of air is set to be small relative to the viscosity force. A further optimum shape can be determined by conducting an experiment, a fluid analysis or the like by using a computer on the basis of a shape determined from the above-described optimizing condition, and by adding some correction.

Figure 6A:
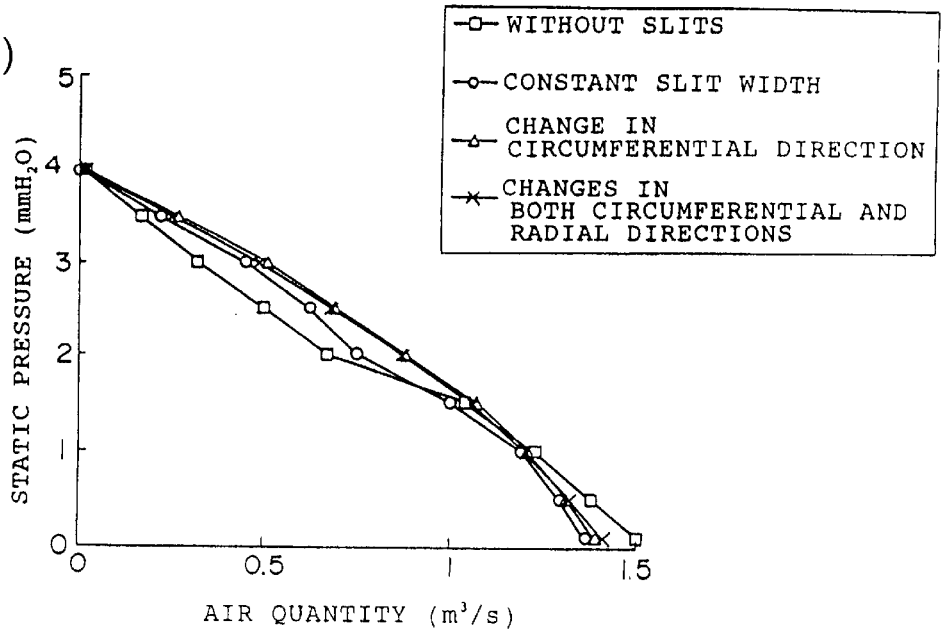
FIG. 6(*a*) is a P–Q characteristic diagram and FIG. 6(*b*) is an air quantity vs. noise characteristic diagram, in which the characteristics of the blower in accordance with Embodiment 1 of the present invention are compared with those of a conventional blower.
Figure 6B:
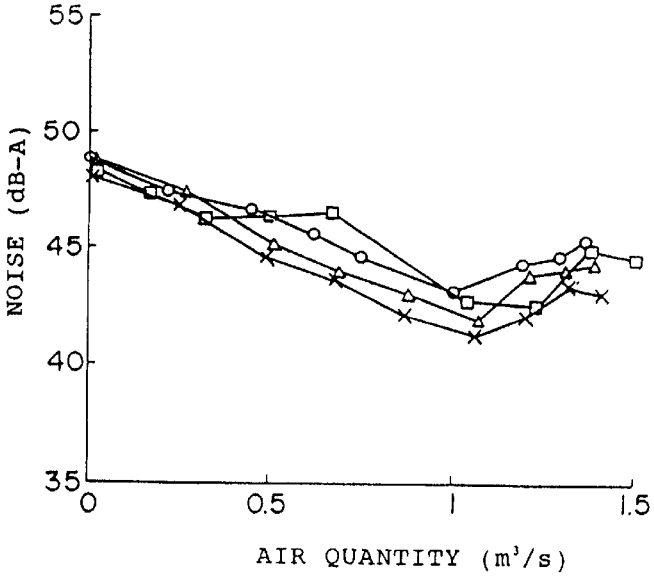

Next, the measurement results of the actual characteristics of the blower which has been optimized on the basis of the above-described condition are shown. FIGS. 6(*a*) and 6(*b*) show the results of experimental comparison of the characteristics of the conventional blower without slits in the annular wall, the blower in which the width of the gap of the slit is constant over the entire circumference, the blower in which the width w of the gap of the slit is changed only in the circumferential direction as described in the prior art (Japanese Patent Application No. 9-151450) and the blower according to this embodiment in which the width of the gap of the slit is changed in both circumferential and radial directions. For these blowers, blower parts which are now being mass-produced were used, and only the housing was prepared by cutting on a trial basis. The measurement was made on each blower under the same condition. All of the used blowers were of the same size, fans of these blowers were of the same size and shape, and motors used for driving these fans had the same characteristics. FIG. 6(*a*) is a diagram in which the P–Q characteristics are compared when the fans of these blowers are driven at a same rotational speed. In the conventional blower without slits in the annular wall, the air quantity decreases extremely, entering a stall state, when some degree of static pressure is applied. In the case where the width of gap of the slit is constant, although the stall state is improved as compared with the conventional blower, the stall state is not eliminated completely. By contrast, in the case where the width of gap of the slit is changed only in the circumferential direction, and in the case where it is changed in both of the circumferential direction and the radial direction, the stall state is avoided substantially completely. FIG. 6(*b*) is a diagram in which the air quantity vs. noise characteristics are compared when the fans of these blowers are driven at a same rotational speed. The conventional blower without slits in the annular wall has a region where the noise increases with the stall of fan, but other three types of blowers with slits do not have a region where the noise changes greatly, but exhibit stable characteristics over the whole region. However, in the case where the slit width is constant or in the case where the slit width is changed only in the circumferential direction, the noise is high on the whole as compared with the case where the slit width is changed in both of the circumferential direction and the radial direction, and the noise is rather higher than that of the conventional blower in the region where the static pressure is low. In the case where the slit width is changed in both of the circumferential direction and the radial direction, the noise exhibits a low value over the whole region, and is lower than that of the conventional blower in almost all regions. Although the above-described characteristics are those in the case where the fan is driven at the same rotational speed, the blower is often used in a constant air blowing condition in actual use, that is, in a condition in which the static pressure and the air quantity are equalized. In such an air blowing condition, the blower of the present invention can be operated at a low rotational speed of fan, so that the noise difference between the blower of the present invention and the conventional blower without slits in the annular wall further increases, and at the same time, the power consumption at the motor portion is reduced, so that a blower with low noise and low power consumption is provided.

Figure 7A:
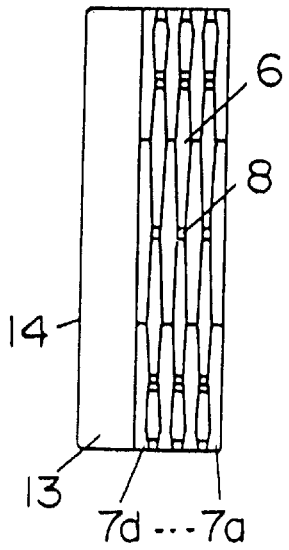
FIG. 7(*a*) is a side view and FIG. 7(*b*) is a front view, showing a case where the external shape of a housing is polygonal.
Figure 7B:
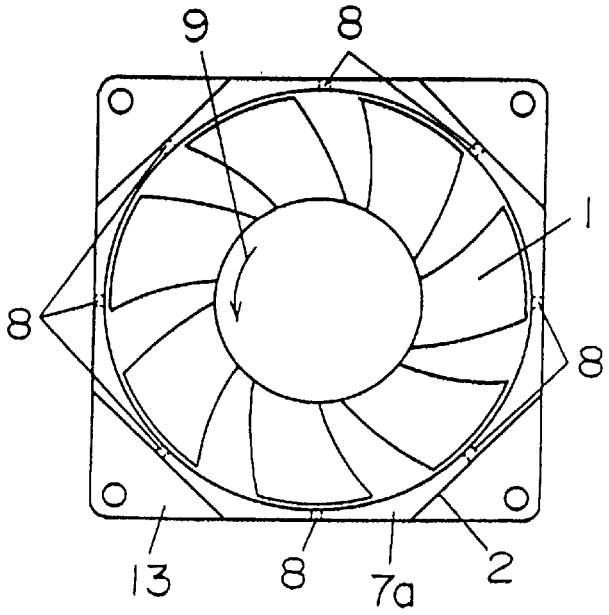
Figure 8A:
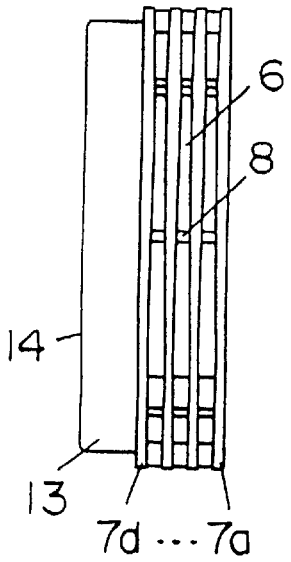
FIG. 8(*a*) is a side view and FIG. 8(*b*) is a front view, showing a case where the external shape of a housing is elliptical.
Figure 8B:
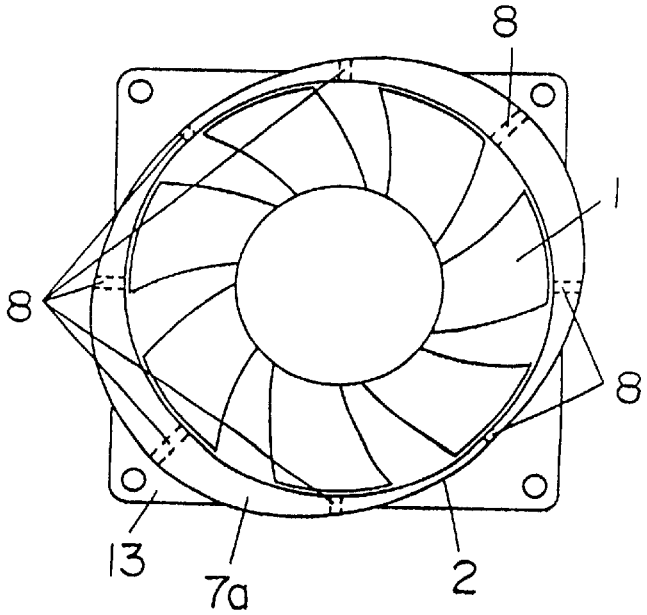
Figure 9A:
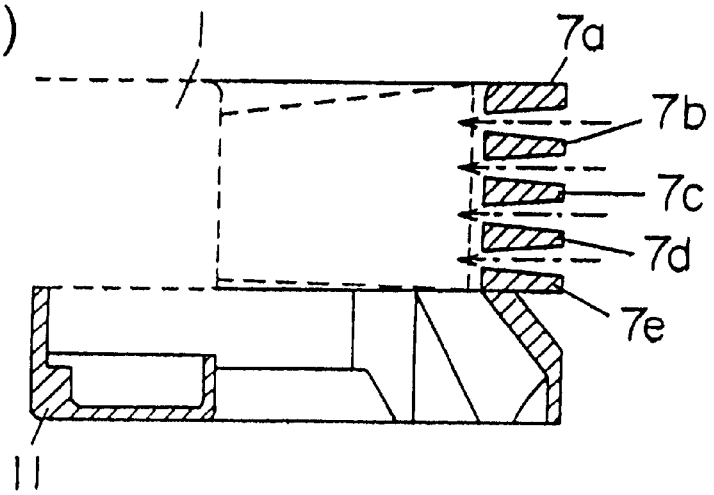
FIGS. 9(*a*) to 9(*c*) are views showing the shape of an annular plate of another example in accordance with Embodiment 1 of the present invention.
Figure 9B:
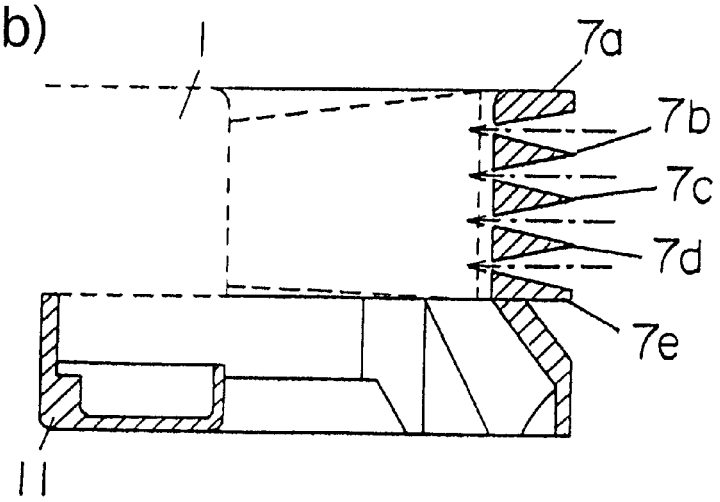
Figure 9C:
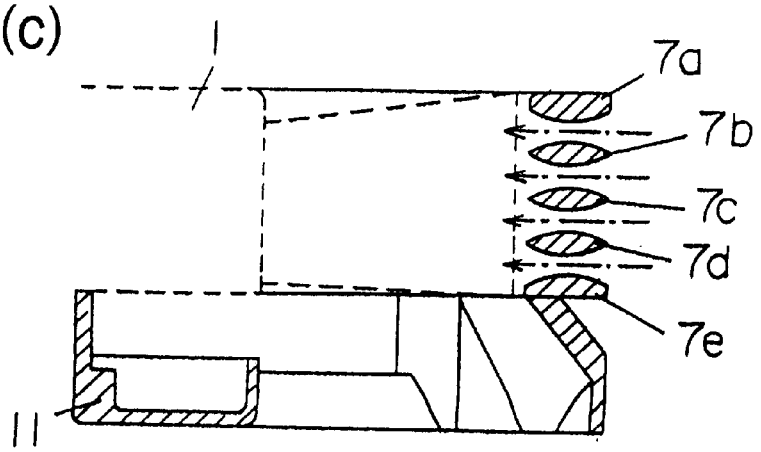

In the above-described embodiment, the outer peripheral shape of the annular wall 2 is a circular shape whose four sides are cut into a plane shape. However, for any outer peripheral shape such as a polygonal shape as shown in FIG. 7 and an elliptical shape as shown in FIG. 8, needless to say, optimization can be performed in the same condition, by which a blower with high P–Q characteristics and low noise can be provided. Also, although not shown in the figure, when the outer peripheral shape of the annular wall is circular, the width of gap of the slit is changed only in the radial direction so that the inflow of air to the slit is smooth, by which the same effect can be achieved. Also, although the cross section of the annular plate 7*a* to 7*e* has a spindle shape in the above-described embodiment, it may have a trapezoidal shape as shown in FIG. 9(*a*) or may have a triangular shape as shown in FIG. 9(*b*). From the viewpoint of smoothening the inflow of air flow 5, the spindle shape as shown in the above-described embodiment is superior to other shapes. Even in the case where the shape is trapezoidal or triangular, however, the noise is reduced as compared with the case of the prior art where the width w of gap of the slit is not changed in the radial direction. Also, the trapezoidal shape and the triangular shape are simpler than the spindle shape, so that the annular plate of these shapes can be easily mass-produced, and the productivity is high. Alternatively, when the cross section of the annular plate 7*a* to 7*e* is formed into an aerofoil shape such that the width of gap of the slit is minimal at the intermediate portion as shown in FIG. 9(*c*), the shape becomes complicated, so that it is difficult to integrally mold the annular plates 7*a* to 7*e* and the housing 13 by a method such as resin injection molding, which makes the annular plates unsuitable for mass production. However, in the case of the aerofoil shape, together with a smooth inflow of air at the outer peripheral portion of the annular wall, air flows into a wide range of the fan 1 even at the inner peripheral portion of the annular wall, so that the state of air flows on the fan 1 is made uniform. Thus, the separation of air flows on the fan 1 is restricted, and the characteristics are further improved.

(Embodiment 2)

FIG. 10 shows Embodiment 2. In the above-described Embodiment 1, a molding method and the like for a housing have not especially been described. In this embodiment, a molding method for a housing and an example of optimization matching with the molding method are described. FIGS. 10(*a*) to 10(*c*) show a housing for a blower of this embodiment. In FIGS. 10(*a*) to 10(*c*), a housing 13 has a boss portion 11 serving as a bearing support portion to which a motor portion is fixed and a base portion 14 which is an installation reference of the blower, and includes annular plates 7*a* to 7*e* connected longitudinally via spacers 8 on the base portion 14. These annular plates 7*a* to 7*e* have such a shape that is obtained by cutting a thin ring body to be linear on four sides thereof. All of these elements are molded integrally by resin injection molding. A gap of each slit 6*a* to 6*d* is formed so that the outer peripheral side of an annular wall 2 is wider than the inner peripheral side thereof by forming the cross section of the annular plate 7*a* to 7*e* into a spindle shape, and further, a width w of gap of each slit 6*a* to 6*e* is changed in the circumferential direction, by which the inflow resistance of each portion is made equal over the entire circumference as in Embodiment 1. However, this embodiment differs from Embodiment 1 in that the slits 6*a* to 6*e* are formed so as to be somewhat inclined with respect to a plane perpendicular to the rotating shaft of a fan 1, and this inclination is changed depending on the slit.

Figure 11A:
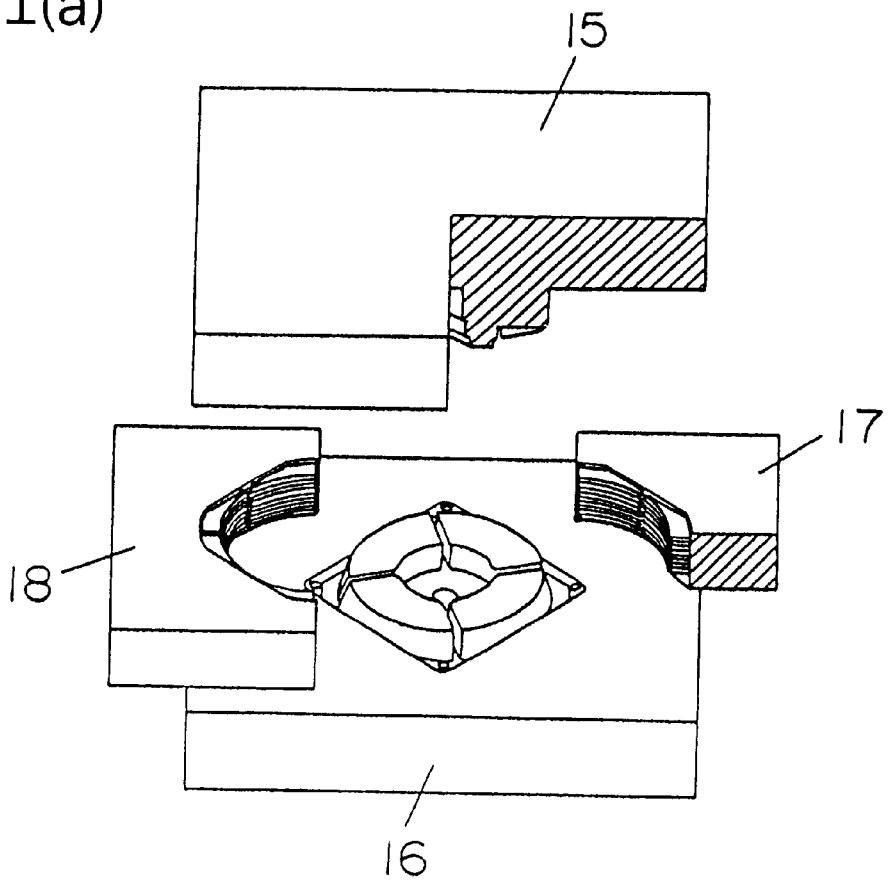
FIG. 11(*a*) is a partially cutaway perspective view and FIG. 11(*b*) is a top view, showing a construction of a mold for molding the housing for the blower in accordance with Embodiment 2 of the present invention.
Figure 11B:
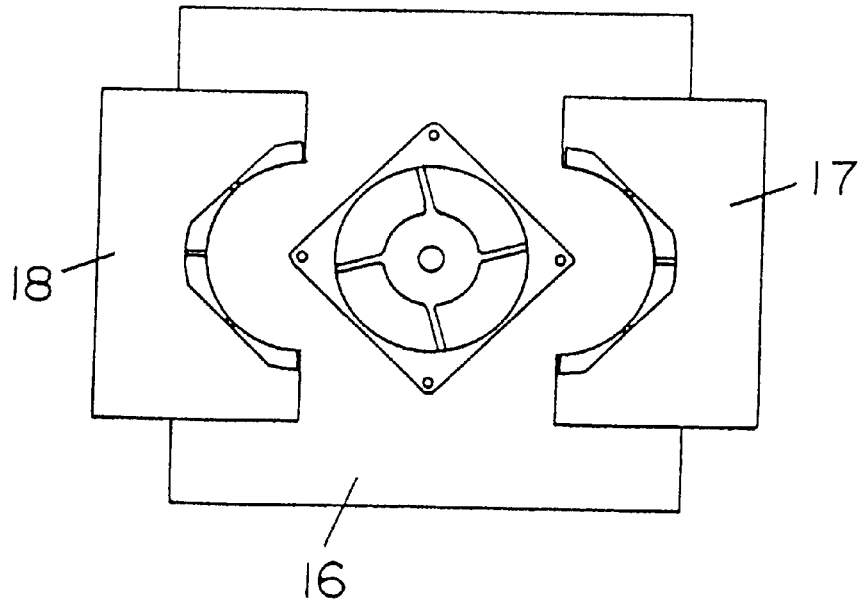
Figure 12:
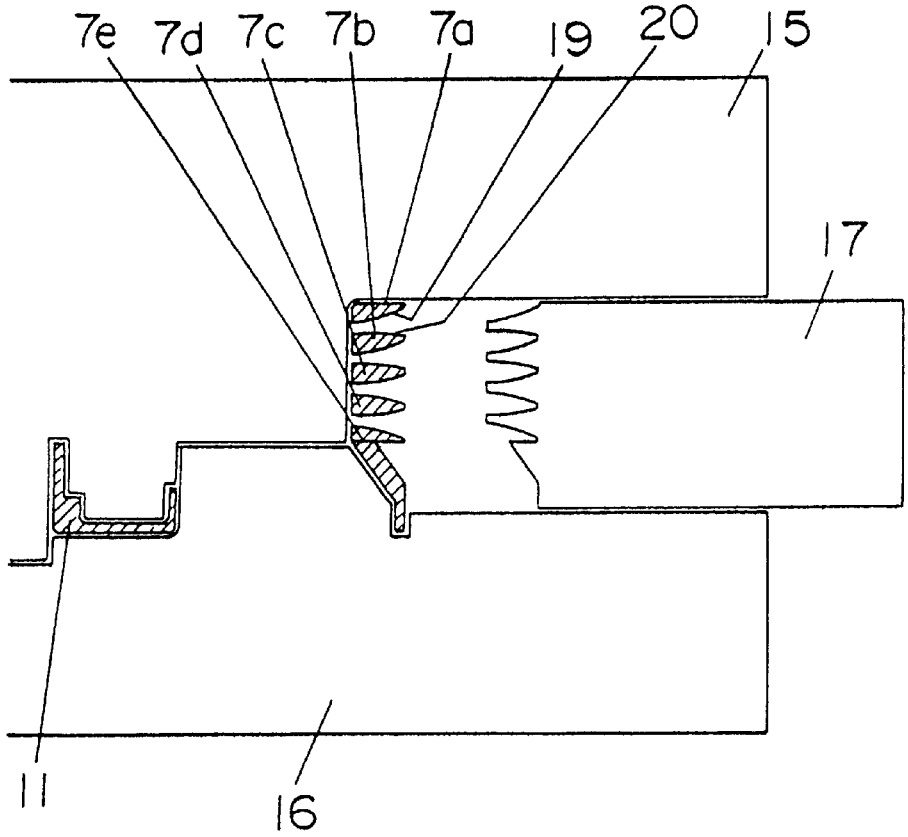
FIG. 12 is a construction view of the mold for molding the housing for the blower in accordance with Embodiment 2 of the present invention.

FIG. 11 is a schematic view showing a construction of a mold for molding the housing 13 of this embodiment. As shown in FIG. 11, the mold has a relatively simple configuration consisting of upper and lower molds 15 and 16 and two slide cores 17 and 18. Such a mold configuration is very general as a method for molding a housing for a conventional blower without slits in the annular wall, and is excellent in terms of mass production. In order to mold the housing with this mold configuration, as shown in FIG. 10(*b*), spacers 8*a* at the four-corner portions are formed in the radial direction, but spacers 8*b* at four-side portions are formed so as to be inclined with respect to the radial direction. If the spacers 8*b* are inclined in this manner, although the spacers 8*b* obstruct the air flow from the outer periphery of the annular wall 2 to the inner periphery thereof, and deteriorate the characteristics, the effect of inclination of the spacers 8*b* is reduced by arranging the spacers 8*b* at the centers of the four-side portions where the length L in the radial direction of the annular wall 2 is the smallest. Also, the slide cores 17 and 18 slide so as to be opposed to each other while maintaining a planar shape perpendicular to the center axis of the housing. By utilizing the fact that the slits 6*a* to 6*d* of the housing 13 become wider toward the outer peripheral side, the angles of the upper face 19 and the lower face 20 of the slit 6*a* are changed as shown in FIG. 12, so that the slits 6*a* and 6*d* inclined with respect to these faces can be molded.

Figure 13A:
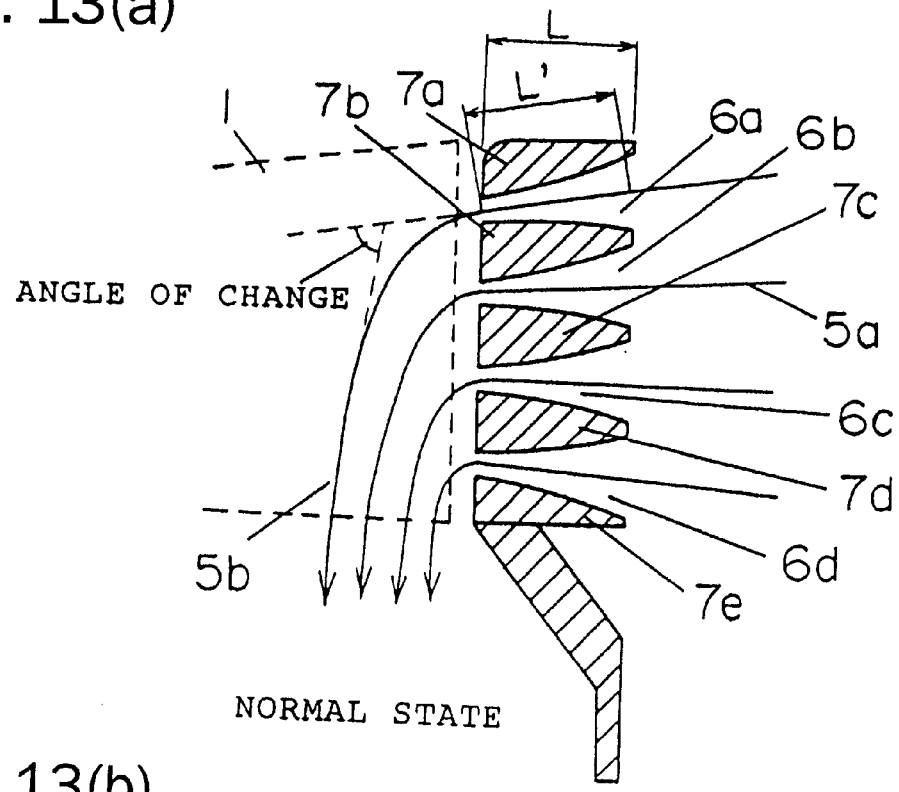
FIGS. 13(*a*) to 13(*b*) are views showing the flow of air in the vicinity of slits of the blower in accordance with Embodiment 2 of the present invention.
Figure 13B:
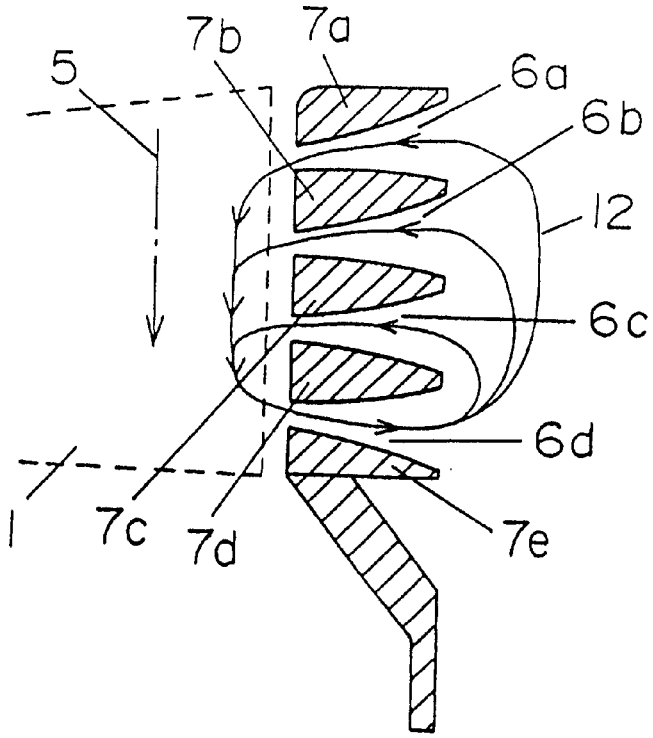
Figure 15:
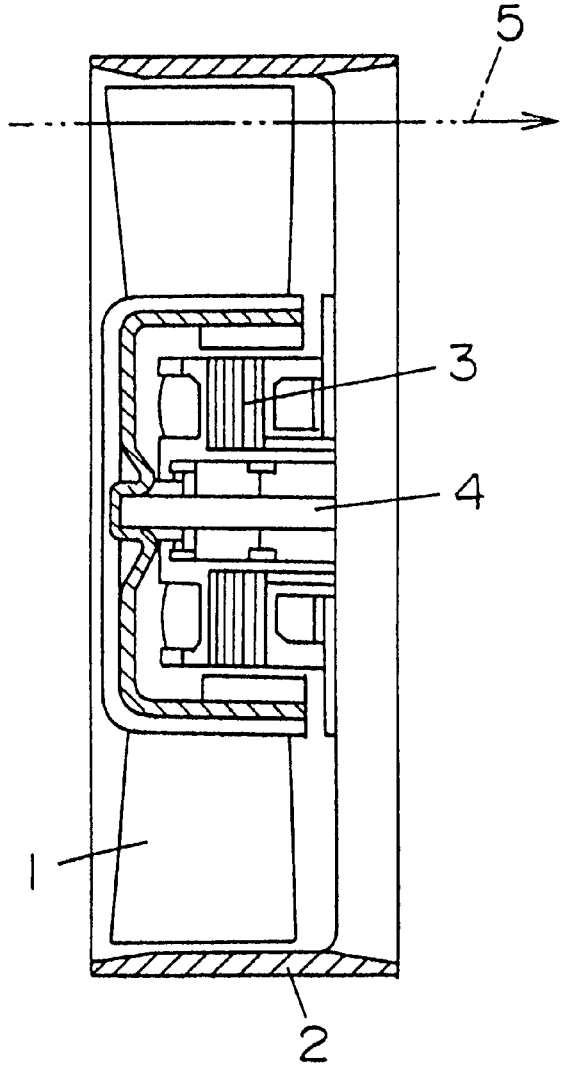
FIG. 15 PRIOR ART
FIG. 15 is a sectional view of a conventional blower.
Figure 17:
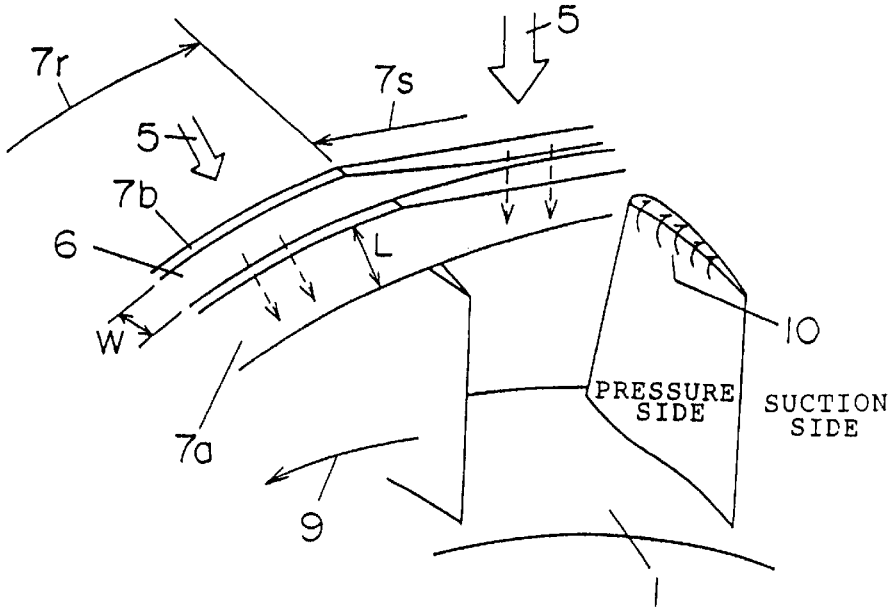
FIG.17 PRIOR ART
FIG. 17 is an explanatory view showing an effect of a slit of the blower.
Figure 18:
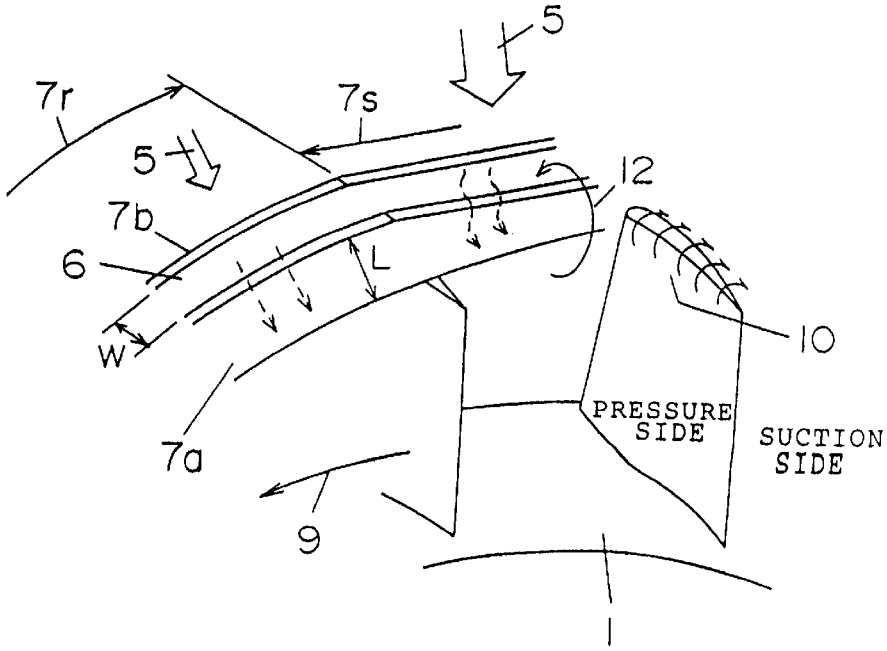
FIG.18 PRIOR ART
FIG. 18 is an explanatory view showing an effect of a slit of the blower.

This configuration such that the slits 6*a* to 6*d* are somewhat inclined with respect to the plane perpendicular to the rotating shaft of a fan has such effects as described below. FIGS. 13(*a*) and 13(*b*) show an air flow 5 at the slit portion. As shown in FIG. 13(*a*), an air flow 5*a* flowing in through the slits 6*a* to 6*d* in an ordinary air blowing state is converted into an air flow 5*b* in the substantially axial direction by the fan 1. At this time, some amounts of energy are needed to change the direction of the air flow 5. Therefore, a state in which the inner peripheral side of the slits 6*a* to 6*d* is inclined in the discharge direction of the air flow so as to minimize the change of angle is excellent in terms of efficiency. Also, by inclining the slits 6*a* to 6*d,* the length L' in the flow direction of the air flow 5 becomes larger than the length L between the inner periphery and the outer periphery of the annular wall 2. Therefore, when the width w of the gap of the slits 6*a* to 6*d* is set to be equal, an effect of making the air flow 5 into a laminar flow is higher than when the slits 6*a* to 6*d* are not inclined. Further, in this embodiment, for the upstream-side slits 6*a* and 6*b,* the inner peripheral side is inclined in the discharge direction of the air flow as described above, but for the downstream-side slit 6*d,* the outer peripheral side is inversely inclined in the discharge direction of the air flow. The purpose of this is to introduce air in a wide range to the inner periphery of the annular wall 2 and thereby to increase the air quantity by changing the angles of the slits 6*a* to 6*d.* Also, as shown in FIG. 13(*b*), when the blower is used in a state of high static pressure, disk circulation 12 occurs such that air flows backward through the downstream-side slit 6*d* and is sucked again into the upstream-side slits 6*a* to 6*c,* so that the efficiency is decreased. However, the outer peripheral side of the downstream-side slit 6*d* is inclined in the discharge direction of the air flow 5, opposite to the upstream side of the slits 6*a,* 6*b* and 6*c,* so that the flow path from the downstream-side slit 6*d* to the upstream-side slits 6*a,* 6*b* and 6*c* is prolonged, making an effect of restraining the disk circulation 12.

By the above-described configuration, a blower which has a high ability of mass production, excellent P–Q characteristics, low noise, and a high efficiency can be provided by merely adding a slight correction to the conventional manufacturing method and facility for a blower, though the shape becomes somewhat complicated.

(Embodiment 3)

Although the number of slits 6 is constant over the entire circumference in the above-described embodiments, the same optimization can be performed by additionally changing the number of slits 6. FIGS. 14(*a*) to 14(*c*) show a blower housing of Embodiment 3. In FIG. 14(*a*), the number of slits 6 at four-side portions differs from the number at other portions in this embodiment. When the number of slits changes in this manner, it is not the inflow resistance of only one slit but the quantity of air flowing in through a plurality of slits that should be made equal over the entire circumference. The quantity of air per one slit is expressed in the same manner as the second equation in Embodiment 1. Therefore, taking the number of slits at a portion concerned as n, the sum ΣQ of the quantity of air flowing in from that portion is expressed as $$\sum Q = \frac{n \cdot \Delta P}{12\eta \int_0^L \frac{1}{w(l)^3} dl} \tag{4}$$

where, ΔP is a pressure difference caused by the rotation of the fan, and η is the viscosity of air, which is constant at each portion. Therefore, the condition for making ΣQ constant is expressed as $$\frac{1}{n} \cdot \int_0^L \frac{1}{w(l)^3} dl = \text{constant} \tag{5}$$

Thereupon, by changing the width of the gap of s slit 6 and the number of slits 6 in accordance with this equation, the inflow quantity of air is made equal over the entire circumference, whereby a blower of large air quantity and low noise is provided, in which blade vibrations, disk circulation and the like are restrained, P–Q characteristics are not deteriorated, and noise does not increase.

As is apparent from the description of the above embodiments, according to the inventions defined in the claims, the annular wall is formed so as to be spaced from the blade tips of the fan, the annular wall is formed with slits which establish communication between the inner peripheral portion and the outer peripheral portion of the annular wall at the portion opposed to the blade tips, and the width of the gap of the slit is changed so that the quantity of air flowing into the inner peripheral portion of the annular wall through the slits is equal over the entire circumference. Therefore, the air blowing state is improved by restraining the occurrence of vortexes and the separation of air flows on the suction side of the fan. At the same time, blade vibrations, disk circulation and the like can be restrained. Moreover, the P–Q characteristics can be improved as compared with the conventional blower, and a reduction in noise can be achieved.

What is claimed is:

1. A blower comprising an annular wall (2) formed to be spaced from blade tips of a fan (1), said annular wall (2) having slits (6) formed at a portion opposed to said blade tips to establish communication between inner and outer peripheral portions of said annular wall (2), so that air is sucked into the inner peripheral portion of said annular wall (2) from the outer peripheral portion of said annular wall (2) through said slits (6) as said fan (1) rotates, characterized in that where the length of an air flow from the outer periphery of said annular wall (2) to the inner periphery thereof is taken as L, and the width of a gap of the slit at a distance l from the inner periphery of said slit (6) is taken as w(l), in order to substantially satisfy the condition expressed as $$\int_0^L \frac{1}{w(l)^3} dl = \text{constant},$$

the width w(l) of the gap of said slit (6) is changed in radial and circumferential directions, whereby the quantity of air flowing into the inner peripheral portion of the annular wall from the outer peripheral portion of the annular wall through said slits (6) is made substantially equal over the entire circumference of the annular wall.

2. A blower comprising an annular wall (2) formed to be spaced from blade tips of a fan (1), said annular wall (2) having slits (6) formed at a portion opposed to said blade tips to establish communication between inner and outer peripheral portions of said annular wall (2), so that air is sucked into the inner peripheral portion of said annular wall (2) from the outer peripheral portion of said annular wall (2) through said slits (6) as said fan (1) rotates, characterized in that where the length of an air flow from the outer periphery of said annular wall (2) to the inner periphery thereof is taken as L, the width of a gap of the slit at a distance l from the inner periphery of said slit is taken as w(l), and the number of slits in the direction of a rotating shaft is taken as n, in order to substantially satisfy the condition expressed as $$\frac{1}{n} \cdot \int_0^L \frac{1}{w(l)^3} dl = \text{constant},$$

the number of said slits (6) is changed, and at the same time, the width w(l) of the gap is changed in radial and circumferential directions thereof, whereby the quantity of air flowing into the inner peripheral portion of the annular wall from the outer peripheral portion of the annular wall through said slits is made substantially equal over the entire circumference of the annular wall.

3. The blower according to claim 1, characterized in that the angle of the direction of an air inflow through the slit (6) is formed to be inclined with respect to a plane perpendicular to an axis about which the fan rotates.

4. The blower according to claim 1, characterized in that the width w(l) of the gap of said slit (6) increases from the inner periphery toward the outer periphery in the same circumferential direction of said annular wall (2).

* * * * *

UNITED STATES PATENT AND TRADEMARK OFFICE

CERTIFICATE OF CORRECTION

PATENT NO. : 6,179,562 B1
DATED : January 30, 2001
INVENTOR(S) : Hiroyasu Fujinaka It is certified that error appears in the above-identified patent and that said Letters Patent is hereby corrected as shown below:

Title page,
Item [30], insert -- Foreign Application Priority Data
December 26, 1997 (JP) 9-359593 --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*